United States Patent [19]

Kober et al.

[11] Patent Number: 4,830,317

[45] Date of Patent: May 16, 1989

[54] AUTOMATIC T-SHIRT RACK/BAG SYSTEM

[75] Inventors: Karl E. Kober, Rush; Lawrence J. Krolak, Middleport, both of N.Y.

[73] Assignee: Mobil Oil Corporation, New York, N.Y.

[21] Appl. No.: 40,264

[22] Filed: Apr. 17, 1987

[51] Int. Cl.[4] ..... B65B 43/28

[52] U.S. Cl. ..... 248/97; 248/99; 221/36

[58] Field of Search ..... 248/95–101; 221/36, 210; 53/384, 390, 386, 572; 220/407, 409; 206/554, 801

[56] References Cited

U.S. PATENT DOCUMENTS

| | | | |
|---|---|---|---|
| 1,424,690 | 8/1922 | Syers | 248/98 |
| 2,341,794 | 2/1944 | Kliwer | 221/210 X |
| 2,815,186 | 12/1957 | Miller | 248/99 |
| 3,204,817 | 9/1965 | Kostering | 221/210 |
| 3,552,697 | 1/1968 | Pinto | 248/97 |
| 3,737,129 | 6/1973 | Foster . | |
| 3,747,298 | 7/1973 | Lieberman . | |
| 3,869,065 | 3/1975 | Wang . | |
| 4,062,170 | 12/1977 | Orem . | |
| 4,305,558 | 12/1981 | Baker . | |
| 4,316,353 | 2/1982 | Suominen . | |
| 4,407,474 | 10/1983 | Swenson | 248/994 |
| 4,417,670 | 11/1983 | Booker | 221/216 |
| 4,437,634 | 3/1984 | Hambleton . | |
| 4,487,388 | 12/1984 | Provan . | |
| 4,541,228 | 9/1985 | Petersen | 53/572 |

FOREIGN PATENT DOCUMENTS

| | | | |
|---|---|---|---|
| 95627 | 3/1963 | Denmark | 248/97 |
| 2302865 | 5/1976 | France | 221/210 |

*Primary Examiner*—Alvin C. Chin-Shue
*Attorney, Agent, or Firm*—Alexander J. McKillop; Charles J. Speciale

[57] ABSTRACT

The present invention is a system for loading and dispensing flexible thermoplastic bags having at least two oppositely disposed walls movable with respect to each other to provide an open mouth for packing. The system includes a bag supply support which supports a supply of bags with one of the walls facing a packaging work area for opening the bag. The system also includes a bag opening means having a bag-attaching element and a pivotal arm on which the bag-attaching means is disposed for contacting the bags. The arm is actuable between a bag-engaging position wherein the bag-attaching element contacts an exposed wall of the bag and attaches it. The arm is also actuable to a bag-loading position wherein the bag-attaching element maintains the attached wall a distance away from a non-attached wall for loading.

22 Claims, 3 Drawing Sheets

AUTOMATIC T-SHIRT RACK/BAG SYSTEM

BACKGROUND OF THE INVENTION

The present invention relates to flexible bag dispensing/holding systems which can be used to pack a number of small items such as food items. The present invention is particularly directed to an automatic dispensing and loading system wherein the effort required of the packer is minimized.

Traditionally, merchandise, such as groceries, has been packaged at the check-out counters by the packer retrieving a bag from a stack, opening the bag usually by a quick motion of the arm which causes air to enter the bag and distend it and positioning and loading the bag upright on the counter. After the items are placed in the bag, it must be somewhat carefully transferred to the customer in a motion which permits the customer to put their arms around the bag at mid- to lower-bag position.

In recent years, merchants have made efforts to overcome the tedious procedure described above by packaging items in plastic bags. However, these plastic bags are limp and, thus, create problems in both loading and carrying.

The plastic industry has attempted to overcome these deficiencies by, first of all, providing handles on plastic bags adjacent to the mouth of the bag. This has helped to alleviate the carrying problem, but the loading operation is still a problem since flexible plastic bags do not provide a structured receptacle for insertion of the items to be loaded.

Elaborate devices have been used to open and support empty bags, such as blowers which fill the bag with air and vacuum systems which hold the walls of the bag apart and upright, but these systems can be expensive, require substantial redesign and modifications of check-out counters and are subject to mechanical breakdown in heavy use.

Although semi-rigid plastic films, such as vinyl, high density polyethylene and high modulus laminar structures formed therefrom, are available and could be used to construct bags which are self-supporting, the cost of such material is far in excess of acceptable bag production commodities and is, therefore, an economically unattractive solution.

U.S. Pat. No. 3,747,298 to Lieberman discloses a wicket bag dispensing unit which includes a vertical wall having a gate formed therethrough and bag opening and expanding means attached to the front of the wall. A stack of bags are secured to the back of the vertical wall with the front side of the first bag abutting the back side of the vertical wall. The Lieberman unit requires that each bag be provided with a lip extending transversely across the width of the bag which is formed by folding down the front side of each bag and heat sealing either end of the fold to the front side of the bag. Lieberman provides hook arms as opening and expanding means, having penetrable ends which would easily disrupt the structural integrity of the side of the bag under even rather mild load conditions. Furthermore, the wicket mounting scheme of Lieberman causes the front side of each of the bags to be somewhat inaccessible for grasping and opening.

U.S. Pat. No. 4,437,634 to Hambleton discloses a device to hold open for loading a limp plastic bag having a pair of integral handles and a body portion terminating in a base. A pair of oppositely-disposed side wall members are upwardly projecting from either side of the base, and each of the wall members are provided with a pair of spaced protuberances affixed to the outer side thereof near the upper edge. Unfortunately, Hambleton makes no provision for holding a supply of bags in position for mounting on the device. Furthermore, the Hambleton device is constrained for movement and flexibility by not only the side walls, but also the back wall, and the bag handles must be carefully fitted over the sides and thence the protuberances before packing the bag. Finally, the Lieberman device would require undue care in removing the bag from the holder.

U.S Pat. No. 3,869,065 to Wang shows an apparatus for dispensing and holding carrying bags which includes a frame, a bag magazine for a supply of individual bags and a carrier means. Also a bag pick-up and holding means is supported reciprocably on the carrier means in a vicinity directly opposite the magazine rail means. The pickup means is operative to move substantially horizontally from an initial position to the foremost bag stored in the magazine and engage serrations or cut-outs in the outermost bag panel only. When the carrier means including the pick-up means returns to the initial position a bag is dispensed and held in open position suspended between the magazine rail means and the pick-up means. Wang, however, requires rather extensive modification of existing check-out lines and also necessitates careful unthreading for removal of the bags from the pick-up and holding means.

U.S. Pat. No. 4,316,353 to Suominen depicts a bag support and dispensing apparatus having support shafts for supporting a plurality of stacked bags by engaging each bag in the stack through aligned apertures in the front and rear walls of the bag. Pivotally mounted, extending hangers are positioned opposite the support shafts to engage a front wall of the top-most bag in the stack through an associated aperture in the front wall, so that the bag is supported in an open loading position by the support shaft at the rear wall and the extending hanger at the front wall. Suominen provides only two-point support for the bag and requires dexterous manual effort by the packer to remove the loaded bag.

U.S. Pat. No. 4,305,558 to Baker discloses a system for supporting a bundle of bags for access and loading adjacent a checkout area of a store which includes a first support member adapted to support a bundle of bags. The first support member includes an elongated substantially horizontally disposed member mounted beneath the countertop of a checkout area so that a substantial portion of the bundle of bags are out of view. A second support member adapted to support one handle of a bag is mounted at a spaced distance apart from the first support member so that the width of a bag in its open condition fits over the support members. Baker, like Suominen, provides only a two-point bag support system which requires care to unthread the apertures from the support members. Furthermore, Baker's system cannot be accommodated by all checkout areas because of the distance between counters.

U.S. Pat. No. 4,062,170 provides an effective holder for loading plastic bags having handle loops. In this patent, a user removes the topmost bag from a stack of bags supported at the rear of the holder, places each of the handle loops of the bag on a respective one of spaced arm portion tabs, loads the bag, and removes the loaded bag from the holder by lifting the handle loops from the tabs. U.S. Pat. No. 4,487,388 to Provan discloses a wire holder for facilitating loading of plastic bags which have integrally-forming carrying handles.

Furthermore, in commonly-assigned copending application Ser. No. 07/036,599 filed 4-10-87 (the contents of which are incorporated herein by reference) a total packing environment has been provided in which a number of bags are simultaneously available to the packer as well as a scheme for holding a stack of bags with a detachable connection maximally accessible at all times to the packer. This system is especially useful in combination with front-side-free thermoplatic bags such as those disclosed and claimed in commonly-assigned co-pending U.S. application Ser. No. 925,752 filed Oct. 30, 1986, the contents of which are incorporated herein by reference.

In all the systems however, the packer is required to manually grasp the front of the bag, and in one form or another open the bag and position it on some support element in order to commence loading. This effort requires time and manual dexterity by the individual packers. Thus, it has inherent drawbacks.

It is, therefore, an object of the present invention to eliminate the necessity for a packer to manually grasp the side of the bag and position it over appropriate support elements prior to loading the bag with individual items.

Other and further objects will be made known as the invention is described hereinbelow.

SUMMARY OF THE INVENTION

The present invention is a system for dispensing and loading flexible bags having at least two oppositely disposed walls movable with respect to each other to provide an open mouth for packing. The system includes a bag supply support means which supports a supply of bags with one of the walls facing a packaging work area for opening the bag. The system further includes a bag opening means having a bag attaching element and an arm means on which the bag-attaching means is disposed for contacting the bags. The arm is actuable between a bag-engaging position wherein the bag attaching element contacts an exposed wall of the bag and attaches it, and a bag-loading position wherein the bag-attaching element maintains the attached wall a distance away from the non-attached wall for loading. Preferably the system further includes a base on which the bag supply means is fixed and on which the bag opening means is mounted for actuation.

The bag supply support means can be a vertical element such as an upwardly extending wall adjacent a side of the base over which the bags are hung for opening and packing. The bag supply support means can also include a bag holding means such as an upwardly extending protrusion or an outwardly extending protrusion for insertion into an aperture formed in a stack of bags. Furthermore, the system is preferably provided with a pad element arranged on the vertical wall opposite the bag-attaching element for resilient abutment of the bag-attaching element thereagainst.

A further preferred embodiment also includes a bag retaining means positioned on the back of the wall such as a retaining bar biased towards the back of the vertical wall at a position proximal the top of the wall for retaining the top extensions of the bag which hangs at the back of the wall. This bar can be biased by a slot means located at either side of the wall which carries the bar under the force of gravity downwardly towards the wall.

The bag attaching element which is carried on one end of the arm can be one of a mechanical bag-grabbing means, a reduced pressure bag-grabbing means, such as a suction cup or a direct vacuum, or an adhesive bag-grabbing means. In the case of an adhesive, the bag-grabbing means must have sufficient strength to not only attach the front side of the bag thereto, but also to support the bag in the open position against the force of packing a load. Preferably such adhesive can include a roll of adhesive material which can be renewed by removal of the used outer layer.

The arm, can also include a handle for actuating the bag opening means between the bag-engaging position and the bag-loading position. Such an arm means can be an L-shaped solid support member hinged at one end to the base, preferably at the junction of the wall and the base, or it can be two wire members attached at either side of the base for actuation between the bag engaging position and the bag loading position.

As a result of the present invention the bagging personnel can easily open a thin, limp, bag such as a T-shirt bag by merely using the hinged rack and adhesive pad to eliminate ever touching the bag during the opening and loading operation. The present invention is particularly suitable for use with the front-side-free thermoplastic bags described in U.S. application Ser. No. 925,752 filed Oct. 30, 1986, which has been incorporated herein by reference. This eliminates many steps in the process which will speed up the preparation by 50 to 75%. This is especially useful in express lane situations where speed is essential.

For a better understanding of the present invention, together with other and further objects, reference is made to the following description, taken in conjunction with the accompanying drawings, and its scope will be pointed out in the appended claims.

BRIEF DESCRIPTION OF THE DRAWINGS

Preferred embodiments of the invention have been chosen for purposes of illustration and description and are shown in the accompanying drawings wherein:

FIG. 7 is a schematic of a mechanical bag-grabbing means which can be used as a bag-attaching element herein; and FIG. 8 is a schematic of a reduced pressure bag-grabbing means which can be used as a bag-attaching element in the present invention.

DETAILED DESCRIPTION OF THE DRAWINGS

Figure 1:
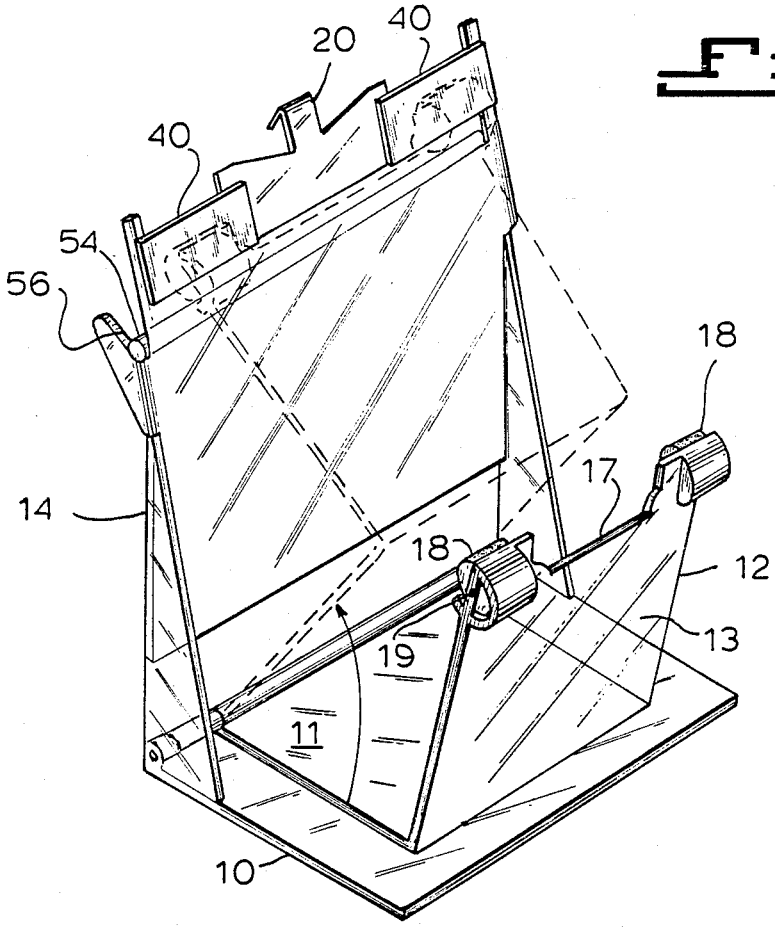
FIG. 1 is a left oblique perspective view of one embodiment of the present invention.

The device shown i FIG. 1 and la includes a base 10 having an L-shaped pivotal arm 12 with a base leg 11 and an upright leg 13. The base leg 11 is hingedly connected to the base at the junction of a vertical wall 14 (on which the bags can be hung) and the base member 10. Upright leg 13 extends to and supports bag contacting adhesive rollers 18. Preferably, such rollers will be rotatably mounted around axles 19 and can have an outer peelable surface to renew the adhesive surface by removal of the outer layer.

Figure 1A:
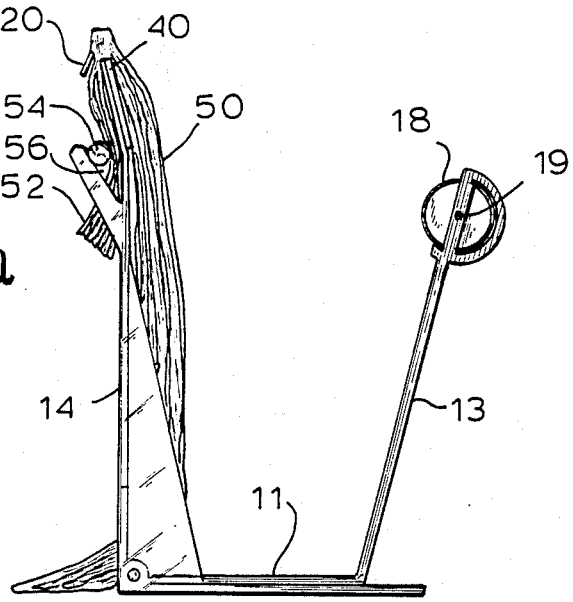
FIG. 1*a* is a side elevational view of the embodiment shown in FIG. 1 with a stack of bags hung thereover.

Referring to FIG. 1, the pivotal arm 12 is shown in phantom in the bag-engaging position and the solid lines depict the bag opening and loading position. Referring to both FIGS. 1 and 1*a*, a bag holding projection 20 is shown at the top of the vertical wall 14 which can be inserted through an aperture in a stack of bags, such as T-shirt bags, above a point of detachment whether perforated or "front-side-free." Thus, a stack of bags 50 can be hung over the rear wall 14 and with the T-shirt handles 52 draped over the rear of the vertical wall. Preferably the bag holding wall also includes a retaining bar 54 which is biased against the draped handles 52 by, for example, bar holding slots 56 located on either side of the vertical wall 14.

Another preferred element of the present invention includes pad elements 40 located on either side of the vertical wall 14 at the top thereof opposite the adhesive rollers 18 for resilient abutment of the rollers thereagainst to insure adequate contact with the face of the bag to effect adhesion between the rollers 18 and the front wall of the bag. The entire structure shown in FIGS. 1 and la can be made of plexiglass and the leg 13 can be formed with a depression 17 to provide a handle suitable for operating the bag-opening means.

Figure 2:
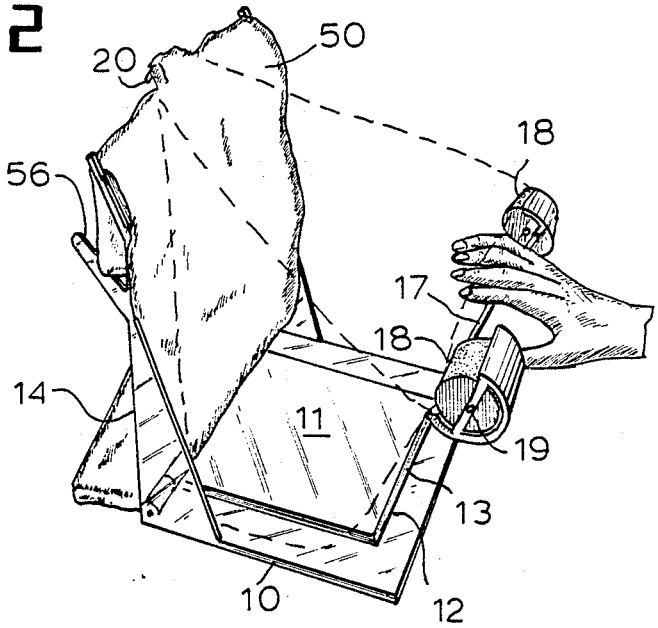
FIG. 2 is a perspective view showing operation of the device in phantom.
Figure 3:
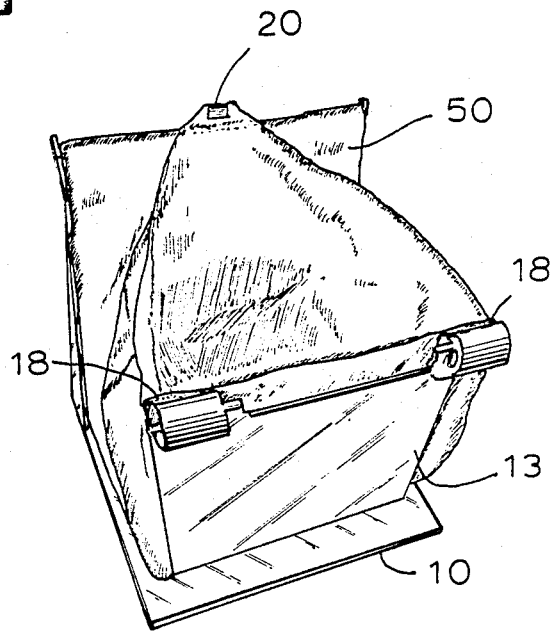
FIG. 3 is a perspective view of the embodiment shown in FIG. 2 with a bag opened and in place for packing.

Referring to FIGS. 2 and 3 the apparatus can be shown in operation. Specifically in FIG. 2, the arm member 12 is grasped by the handle 17 and pushed forwardly toward the stack of bags 50 which is draped over the rear wall 14. The adhesive roller 18 makes contact with the front side of the bag and the arm is returned rearwardly to its resting position bringing the front side of the bag along with it thereby opening the bag for packing as shown in FIG. 3.

The adhesive roller 18 serves as a bag-attaching element, which can also be either a mechanical bag-grabbing means, such as that shown in FIG. 7, or a reduced pressure bag-grabbing means, such as shown in FIG. 8.

The location of the hinge point determines how sloped the opening on the bag is in the loading position. This can be important to the loading operation inasmuch as too much slope reduces the opening significantly.

The present system works much better with a front-side-free bag which has a strong rear perforation forming a holding point for the opening of the bag for loading. Once the bag is opened for loading, the rear perforation is the only point of attachment which supports the bag. Therefore, it must be able to withstand the stress imposed during the loading process, and it must also be capable of being easily torn off after loading.

In the case of a front-side-free bag, the front layer is easily acquired by the adhesive. However, current bag technology which provides a front perforation can also be used when the adhesive is strong enough to overcome the strength of the points of attachment in the front perforation. Similarly as with the front-side-free case, the rear perforations should be strong enough so that the body of the bag will not tear from the tab through which the protrusion 20 has been inserted during loading.

Also with reference to the bag contacting elements 18, the adhesive must be strong enough to acquire the front side of the bag and hold it during loading, but allow release of the bag for removal of the loaded bag. Furthermore, it is preferable to use adhesive which is cost effective and easy to replace.

Figure 4:
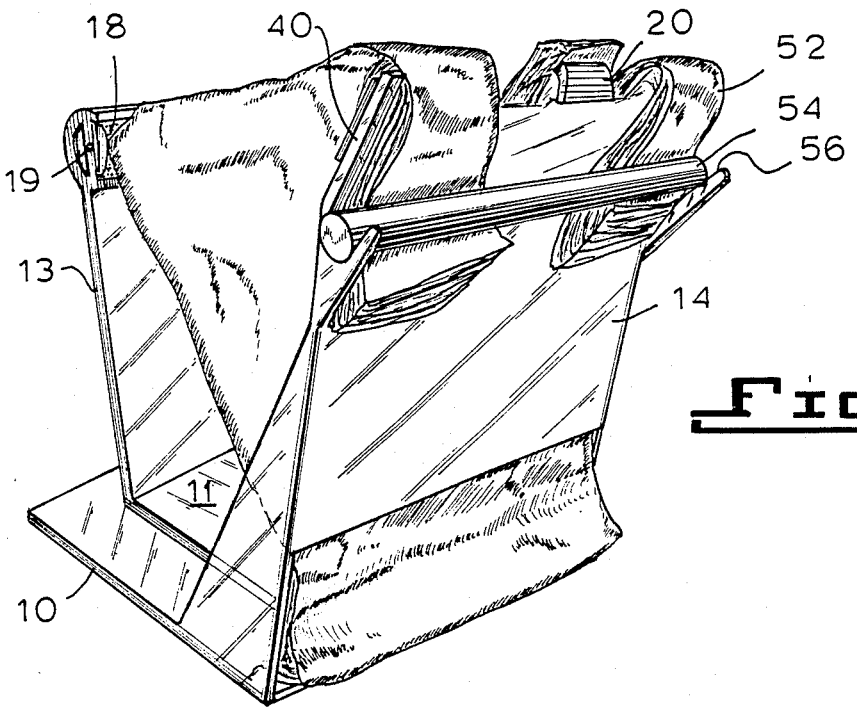
FIG. 4 is a left rear obtuse view of the embodiment shown in FIGS. 2 and 3.

Referring to FIG. 4, a stack of bags is shown in the operative position from the rear of the apparatus. This figure clearly depicts the use of the retaining bar 54 holding the extensions of the bag 52 against the rear of vertical wall 14. This enables the packer to open and load a bag without interference of the top extensions flopping into the area of work provided by the apparatus.

Figure 5:
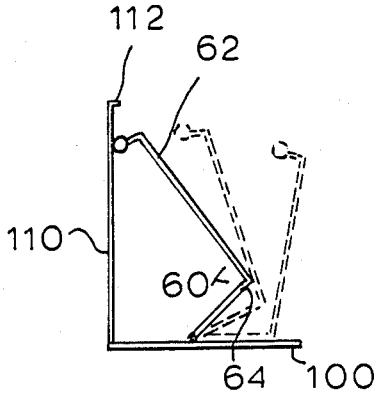
FIG. 5 is a schematic of another embodiment of the present invention with a wire armature.
Figure 6:
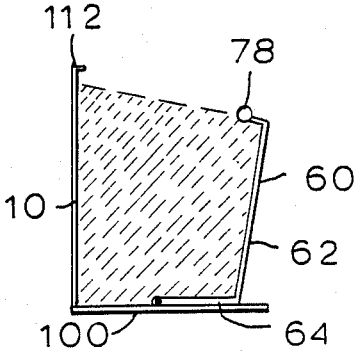
FIG. 6 is a schematic of the device as shown in FIG. 5 representing a fully opened bag positioned for loading.

Referring to FIGS. 5 and 6, another rack is shown in accordance with the present invention which has a wire arms 60 each of which consist of upright leg 62 and base leg 64 which is hingedly connected to the base 100. The bag support element is shown as a vertical wall 110 having an upward protrusion 112 which can be inserted through apertures in a stack of bags. The body contacting element 78 can also be an adhesive roll as shown in the embodiment shown in FIGS. 1 through 4.

In FIG. 5, the movement of the armature to the body contact position is shown in solid lines, while the return bag-loading position is shown in phantom. In FIG. 6, the second embodiment is schematically shown with the armature in the loading position and the bag fully opened.

Thus, while there have been described what are presently believed t be the preferred embodiments of the invention, those skilled in the art will realize that other changes and modifications may be made thereto without departing from the true scope of the invention, and it is intended to claim all such changes and modifications.

We claim:

1. A system for dispensing and loading flexible bags having at least two oppositely disposed walls movable with respect to each other to provide an open mouth for packing, said system comprising:

bag supply support means which supports a supply of bags with one of the walls facing a packaging work area for opening said bag, said bag supply support means comprising a vertical element extending upwardly adjacent said packaging work area over which said bags are hung with said one bag wall exposed to a bag opening means for opening and packing, and bag-holding means which holds a stack of bag in place for dispensing one side at a time, and said vertical element further including bag retaining means which maintains bag extensions against the back of said vertical element away from said work area, said bag supply support means further comprises pad elements fixedly attached at one end to said vertical element, and having free ends arranged opposite said bag-attaching means for resilient abutment of said bag-attaching means thereagainst;

bag opening means having a bag-attaching means and arm means on which said bag-attaching means is disposed for contacting said bags, said arm means being actuable between a bag-engaging position wherein said bag-attaching means contacts said exposed wall of said bag and attaches it, and a bag-loading position, wherein said bag attaching means maintains said attached wall a distance away from the oppositely disposed non-attached bag wall for loading; and a base on which said bag supply means is fixed and on which said bag opening means is mounted for actuation.

2. The system of claim 1 wherein said bag holder comprises a protrusion for insertion through an aperture in a stack of bags.

3. The system of claim 2 wherein said protrusion is upwardly oriented.

4. The system of claim 2 wherein said protrusion is oriented outwardly away from said work area.

5. The system of claim 1 wherein said bag retaining means comprises a retaining bar biased toward said back of said vertical wall at a position proximal the top of said wall.

6. The system of claim 5 wherein said bar is biased by slot means located at the sides of said wall which carries said bar under the force of gravity downwardly add toward said wall.

7. The system of claim 1 wherein said bag-attaching comprises one of mechanical bag-grabbing means, reduced pressure bag-grabbing means, and adhesive bag-grabbing means.

8. The system of claim 6 wherein said bag-attaching means is an adhesive bag-grabbing means having sufficient adhesive strength to pull the front side of a bag from said supply of bags and to support said bag in the open position for packing.

9. The system of claim 8 wherein said adhesive bag-grabbing means comprises a roll of adhesive material which can be renewed by removal of the outer layer.

10. The system of claim 1 wherein said arm means further comprises a handle for actuating between said bag-engaging position and said bag-loading position.

11. The system of claim 1 wherein said arm means comprises an L-shaped solid support member hinged at one end to said base and provided with said bag-attaching element at said other end.

12. The system of claim 11 wherein said arm means is hinged to said base proximal the junction of said bag supply means and said base.

13. The system of claim 1 wherein said arm means is at least one wire support member hinged to said base at one end for actuation and provided with said bag-attaching element at said other end.

14. The system of claim 13 wherein there are two said wire supports hingedly fixed at either side of said base.

15. A system for dispensing and loading flexible bags having at least two oppositely disposed walls movable with respect to each other for providing an open mouth for packing, said system comprising:

bag supply support means which supports a supply of bags with one of the walls of the bags facing a packaging work area for opening the bag, said bag supply support means including a vertical element extending upwardly adjacent a side of a base of said system over which said bags are hung for opening and packing, said vertical element further including a bag retaining means which maintains bag extensions against the back of said vertical element away from said work area, such bag retaining means including a retaining bar biased toward said back of said vertical wall at a position proximal the top of said wall, said bar being biased by a slot means located at the sides of said vertical wall which carries said bar under the force of gravity downwardly and toward said vertical wall;

bag opening means having a bag-attaching means and arm means on which said bag-attaching means is disposed for contacting said bags, said arm means being actuable between a bag-engaging position wherein said bag-attaching means contacts the wall of the bag facing said packaging work area and attaches thereto, and a bag loading position, wherein said bag-attaching means maintains the attached wall of the bag a distance away from the opposing non-attached bag wall for loading the bag;

a base on which said bag supply support means is fixed and on which said bag opening means is mounted for actuation.

16. The system of claim 15 wherein said arm means further comprises a handle for actuation between said bag engaging position and said bag loading position.

17. The system of claim 15 wherein said arm means comprises an L-shaped solid support member hinged at one end to said base and provided with said bag-attaching means at said other end.

18. The system of claim 15 wherein said bag supply support means further comprises a bag holding means which holds a stack of bags in place for dispensing one side at a time for loading.

19. The system of claim 18 wherein said bag holder comprises a protrusion for insertion through an aperture in a stack of bags.

20. The system of claim 19 wherein said protrusion is upwardly oriented.

21. The system of claim 20 wherein said protrusion is oriented outwardly from said work area.

22. The system of claim 7 wherein said bag supply support means further comprises pad elements arranged opposite said bag-attaching element for resilient abutment of said bag-attaching means thereagainst.

* * * * *